US007428397B2

(12) United States Patent
Maseki

(10) Patent No.: US 7,428,397 B2
(45) Date of Patent: Sep. 23, 2008

(54) CIRCULATION SYSTEM FOR DEVELOPING SOLUTION FOR A WET TYPE IMAGE FORMING APPARATUS

(75) Inventor: Motohiro Maseki, Saitama-ken (JP)

(73) Assignee: Hoya Corporation, Tokyo (JP)

( * ) Notice: Subject to any disclaimer, the term of this patent is extended or adjusted under 35 U.S.C. 154(b) by 322 days.

(21) Appl. No.: 11/383,029

(22) Filed: May 12, 2006

(65) Prior Publication Data

US 2006/0257170 A1 Nov. 16, 2006

(30) Foreign Application Priority Data

May 16, 2005 (JP) ..... 2005-142208

(51) Int. Cl.
*G03G 15/10* (2006.01)

(52) U.S. Cl. ..... 399/238

(58) Field of Classification Search ..... 399/237–239, 399/308

See application file for complete search history.

(56) References Cited

U.S. PATENT DOCUMENTS

| | | | | |
|---|---|---|---|---|
| 6,173,147 | B1 * | 1/2001 | Nakashima et al. | 399/308 |
| 6,571,075 | B2 * | 5/2003 | Nakashima et al. | 399/237 |
| 6,687,477 | B2 * | 2/2004 | Ichida et al. | 399/237 |
| 2005/0271422 | A1 | 12/2005 | Saito et al. | |
| 2005/0271423 | A1 | 12/2005 | Yamaguchi et al. | |
| 2005/0281587 | A1 | 12/2005 | Maseki et al. | |

FOREIGN PATENT DOCUMENTS

| | | |
|---|---|---|
| JP | 2000-250318 | 9/2000 |
| JP | 2001-22185 | 1/2001 |
| JP | 2002-278300 | 9/2002 |

OTHER PUBLICATIONS

English Language Abstract of JP 2000-250318.
English Language Abstract of JP 2002-278300.
English language abstract of JP 2001-22185.
U.S. Appl. No. 11/392,745 to Maseki, which filed on Mar. 30, 2006.
U.S. Appl. No. 11/382,817 to Saito et al., which filed on May 11, 2006.

* cited by examiner

*Primary Examiner*—William J Royer
(74) *Attorney, Agent, or Firm*—Greenblum & Bernstein, P.L.C.

(57) ABSTRACT

A wet type image forming apparatus, having a latent image forming unit with a photoconductive drum, and a developing unit with a developing solution supplying system that supplies developing solution to a developing roller, is provided. The developing roller is adapted to supply toner contained in the developing solution to the photoconductive drum. The developing solution supplying system includes a first roller and a second roller. The first roller and the second roller are arranged in vicinity to each other, and the second roller is in contact with the developing roller. A portion of the developing solution is retained in a pit portion between the first roller and the second roller. The developing solution supplying system includes a flow blocking system to prevent the developing solution from flowing down from an upstream surface of the second roller with respect to a rotating direction of the second roller toward the developing roller.

7 Claims, 4 Drawing Sheets

CIRCULATION SYSTEM FOR DEVELOPING SOLUTION FOR A WET TYPE IMAGE FORMING APPARATUS

BACKGROUND OF THE INVENTION

The present invention relates to a wet type image forming apparatus, and particularly to a circulation system for developing solution for the wet type image forming apparatus.

Apparatuses that transfer toner to a recording sheet to thereby form an image include, for example, a dry type image forming apparatus, which applies powder toner to a surface of a developing roller to form an image, and a wet type image forming apparatus, which applies developing solution containing toner in carrier solution to a surface of a developing roller to form an image. The toner employed in the latter apparatus is finer than that employed in the former. Accordingly, the latter provides an image of a higher quality. Further, the wet type image forming apparatus requires less toner for printing an image with and equivalent color density compared to the dry type image forming apparatus. Furthermore, the wet type image forming apparatus generally uses a lower temperature of heat than the dry type image forming apparatus when the toner on a surface of a recording sheet is fixed. Therefore, the wet type image forming apparatus is considered to be advantageous in cost-effectiveness and in energy-efficiency.

FIG. 5 shows an illustrative configuration of such a conventional wet type image forming apparatus, which is disclosed in Japanese Patent Provisional Publication P2001-22185A. The wet type image forming apparatus includes a first applicator roller 210, a second applicator roller 212, a developing roller 214, a photoconductive drum 218, a developing solution container 250, a developing solution supplier pump 252, and a developing solution supplying pipe 228. The developing solution, which is nonvolatile and highly viscid, is carried from the developing solution container 250 to a pit portion formed between the first applicator roller 210 and the second applicator roller 212 via the developing solution supplying pipe 228 by the developing solution supplier pump 252, so that a certain amount of developing solution is sustained as pooled developing solution 242.

The pooled developing solution 242 in the pit portion is applied to surfaces of the first applicator roller 210 and the second applicator roller as an applicator. The second applicator roller 212 is in contact with the developing roller 214, which is also in contact with the photoconductive drum 218, and as the second applicator roller 212 rotates, the developing solution is evenly applied to a surface of the developing roller 214. As the developing roller 214 rotates, a surface of the photoconductive drum 218 becomes in contact with the toner on the developing roller 214, so that the toner contained in the developing solution is stuck to the surface of the photoconductive drum 218 due to an electric field generated between the developing roller 214 and the photoconductive drum 218.

As shown in FIG. 5, the first applicator roller 210 rotates in a clockwise direction, whilst the second applicator roller 212 rotates in a counterclockwise direction. As the first and the second applicator rollers 210, 212 rotate in the respective directions, a level of a central portion of the developing solution may occasionally be raised to be higher than topmost portions of the first and the second applicator rollers 210, 212 due to excessive supply of the developing solution, and so on. In this state, when the first and the second applicator rollers 210, 212 stop rotating, the excessive amount of the pooled developing solution 242 may overflow from the pit portion and run down from one of or both ends of the first and the second applicator rollers 210, 212 (i.e., a left-hand end of the first applicator roller 210 and a right-hand end of the second applicator roller 212).

When the excessive developing solution runs down from the right-hand side of the second applicator roller 212, the developing solution reaches to the surface of the developing roller 214, which has been evenly applied a proper amount of the developing solution as a layer. Thus the layer of the developing solution may be spoiled, and an image forming operation may be affected.

SUMMARY OF THE INVENTION

In view of the foregoing drawbacks, the present invention is advantageous in that an improved wet type image forming apparatus is provided, of which developing solution can be prevented from running down on a developing roller.

According to an aspect of the invention, there is provided a wet type image forming apparatus having a latent image forming unit with a photoconductive drum, and a developing unit with a developing solution supplying system that supplies developing solution to a developing roller. The developing roller is adapted to supply toner contained in the developing solution to the photoconductive drum. The developing solution supplying system includes a first roller and a second roller. The first roller and the second roller are arranged in vicinity to each other, and the second roller is in contact with the developing roller. A portion of the developing solution is retained in a pit portion between the first roller and the second roller. The developing solution supplying system is provided with a flow blocking system to prevent the developing solution from flowing down from an upstream surface of the second roller with respect to a rotating direction of the second roller toward the developing roller.

Optionally, the flow blocking system may include a resilient plate member, of which an edge is in contact with the surface of the second roller. The flow blocking system may be located at a position where the edge of the plate member is disposed between a contact point of the first roller and the second roller and a contact point of the second roller and the developing roller on the upstream surface of the second roller with respect to the rotating direction of the second roller.

Optionally, the plate member may be disposed to form an acute angle with a tangent plane of the surface of the second roller at a position where the edge of the plate member is in contact with the surface of the second roller in an upstream side with respect to the rotating direction of the second roller.

Optionally, the developing solution supplying system may be provided with a layer forming system, which is adapted to scrape off an excessive amount of the developing solution being supplied to the surface of the second roller, and is disposed in a position between a contact point of the first roller and the second roller and a contact point of the second roller and the developing roller on a downstream surface of the second roller with respect to the rotating direction of the second roller. The flow blocking system may be configured to be identical to the layer forming system.

Optionally, the developing unit may be provided with a developing solution collecting system being adapted to collect an excessive amount of the developing solution residually produced in a process to supply the toner to the photoconductive drum. A maximum allowable amount of the developing solution to be supplied to the developing solution supplying system may be equivalent to a maximum allowable amount of the developing solution to be collected by the developing solution collecting system.

Optionally, the first roller and the second roller may be in contact with each other.

Optionally, a clearance may be provided between the first roller and the second roller.

BRIEF DESCRIPTION OF THE ACCOMPANYING DRAWINGS

DETAILED DESCRIPTION OF THE EMBODIMENTS

Referring to the accompanying drawings, a wet type printer according to an embodiment of the present invention will be described in detail.

Figure 1:
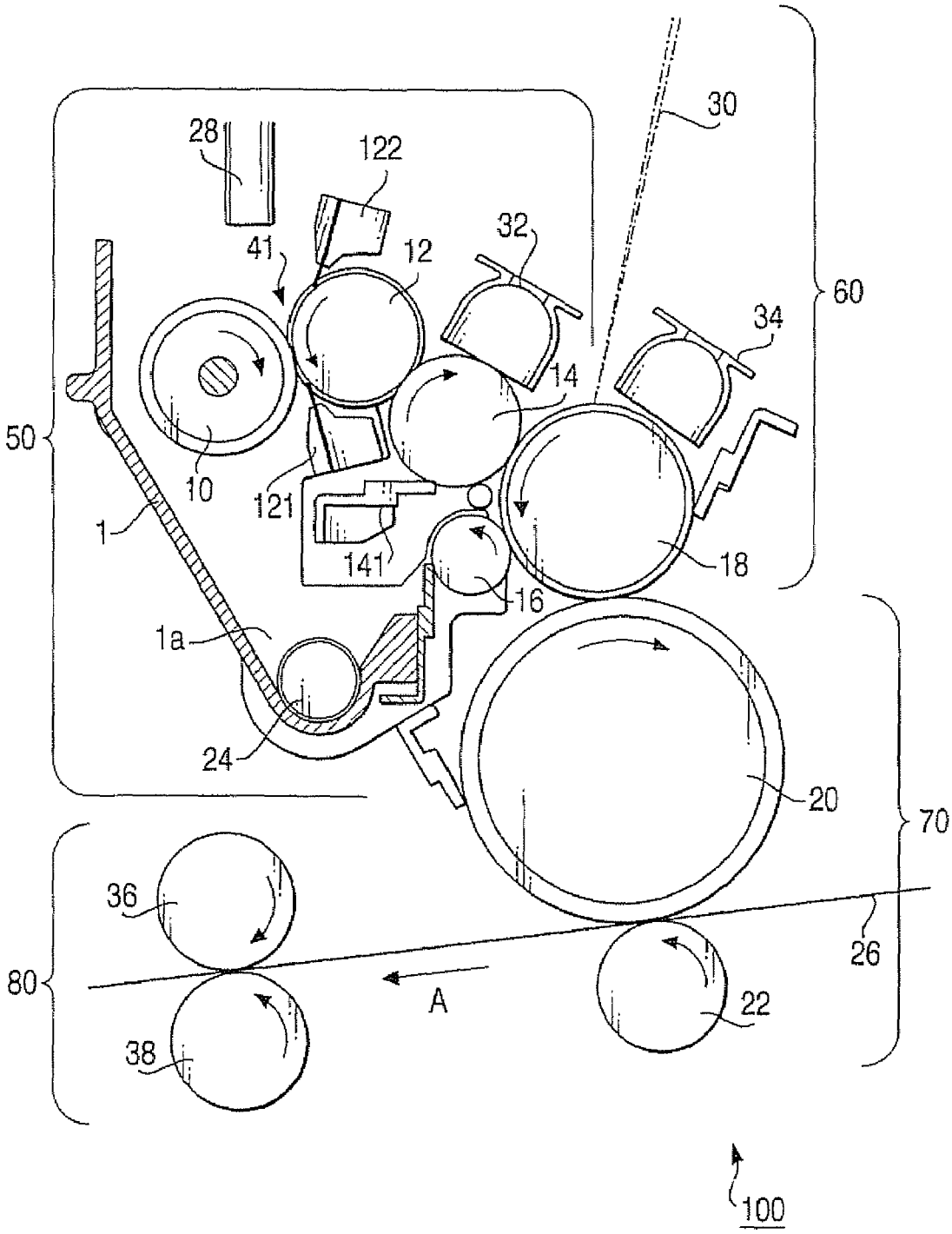
FIG. 1 is a cross-sectional side view showing a structure of a wet type printer according to an embodiment of the present invention.
Figure 2:
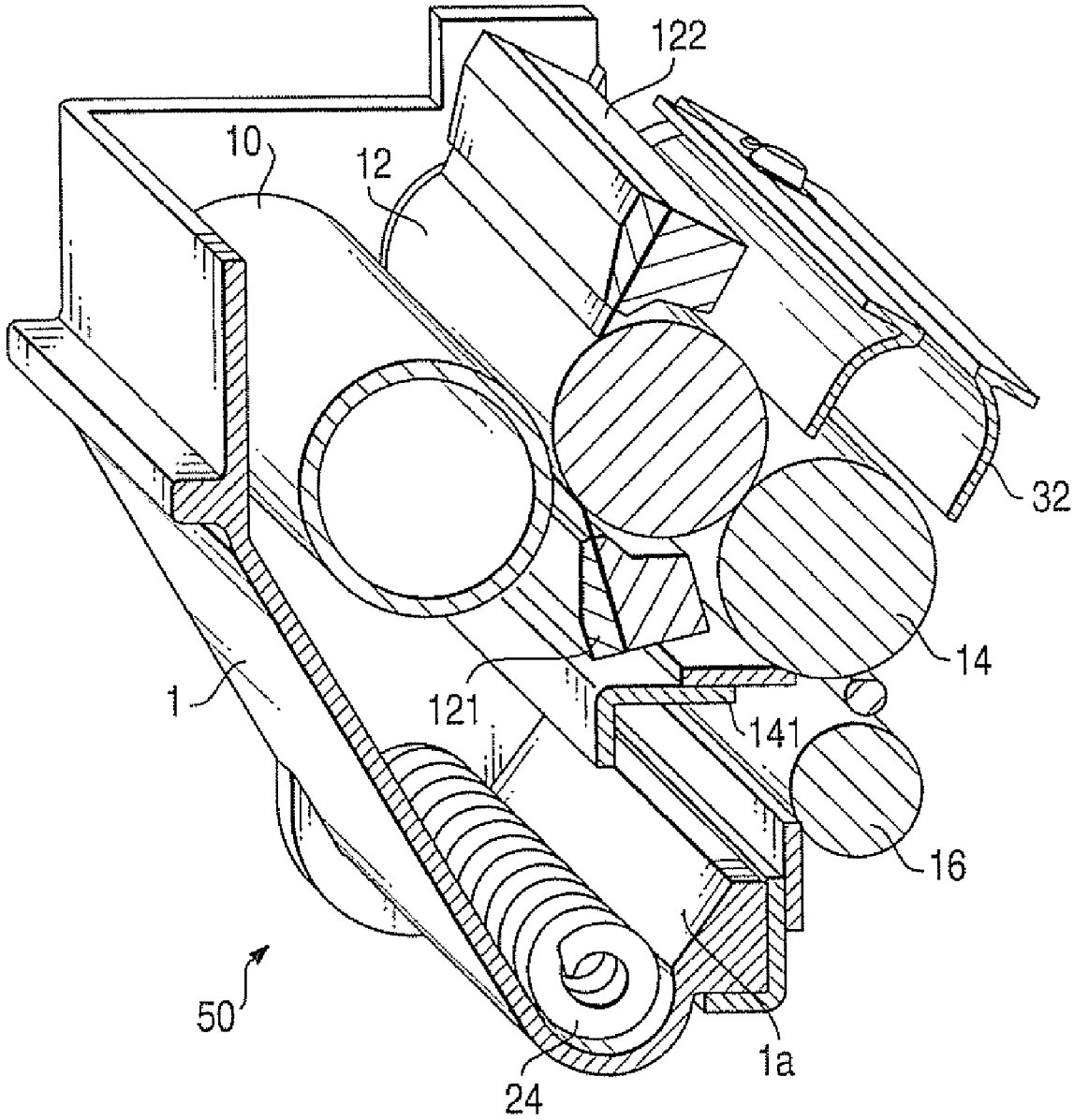
FIG. 2 is a cross-sectional and perspective partial view showing a structure around a developing unit in the wet type printer according to the embodiment of the present invention.

FIG. 1 is a cross-sectional side view showing a structure of a wet type printer 100 according to an embodiment of the present invention. FIG. 2 is a cross-sectional and perspective partial view showing a structure around a developing unit 50 in the wet type printer 100 according to the embodiment of the present invention. The wet type printer 100 in the present embodiment is an apparatus that receives print information (i.e., character and/or image information) from an external apparatus such as a computer, and prints out the characters or the images on a sheet of recording paper in accordance with a so-called electrophotographic imaging process, by exposing a surface of a rotating photoconductive drum 18 to a laser beam 30 modulated according to the print information.

As shown in FIGS. 1 and 2, the wet type printer 100 includes the developing unit 50 with a housing 1, a retainer roller 10, a supplier roller 12, a developing roller 14, a squeeze roller 16, a spirally wound stirrer roller 24, a developing solution supplying tube 28, a corona charger 32, blade units 121, 122, and a blade 141. The wet type printer 100 further includes a latent image forming unit 60 with the photoconductive drum 18, a corona charger 34, a laser source (not shown) to emit the laser beam 30, a transfer unit 70 with an intermediate transfer roller 20 and a secondary transfer roller 22, and a fixing unit 80 with fixing rollers 36, 38.

As indicated by arrows shown in FIG. 1, the retainer roller 10, the developing roller 14, the intermediate transfer roller 20, and the fixing roller 36 respectively rotate in a clockwise direction, whilst the supplier roller 12, the squeeze roller 16, the photoconductive drum 18, the secondary transfer roller 22, and the fixing roller 38 respectively rotate in a counter-clockwise direction.

The retainer roller 10, the supplier roller 12, the developing roller 14, and the squeeze roller 16 are rotatably supported by side surfaces (not shown) of the housing 1 with rotation axes thereof being parallel with one another. The photoconductive drum 18, the intermediate transfer roller 20, the secondary transfer roller 22, and the fixing rollers 36, 38 are rotatably supported at predetermined positions in a body of the wet type printer 100 with rotation axes thereof being parallel with one another and with the rotation axes of the above-mentioned rollers in the developing unit 50.

The developing solution supplying tube 28 is provided above a position between the retainer roller 10 and the supplier roller 12. The developing solution flown through the developing solution supplying tube 28 is supplied to a wedge-shaped pit portion 41, which will be described hereinbelow.

The corona charger 32 is arranged at upper right (i.e., approximately at an one or two o'clock direction) of the developing roller 14 in FIG. 1. Similarly, the corona charger 34 is arranged at an upper right of the photoconductive drum 18. During a printing operation, a recording sheet 26 is carried in a direction indicated by an arrow A, i.e., from a right-hand side toward a left-hand side in FIG. 1. The recording sheet 26 is provided with toner from the developing solution at a position between the intermediate transfer roller 20 and the secondary transfer roller 22, and is further carried to the outside of the wet type printer 100 via the fixing rollers 36, 38.

The developing solution is stored in a developing solution container (not shown), and consists of toner and carrier solution. Density of the developing solution is adjusted in a predetermined weight ratio, for example approximately 30% as toner and the remaining 70% as carrier solution. The carrier solution may be for example petroleum solvent. The developing solution in the developing solution container is carried by a pump (not shown) to the pit portion 41, which is formed with surfaces of the retainer roller 10, the supplier roller 12, and the side surfaces of the housing 1.

The developing solution pooled in the pit portion 41 is applied to the surface of the supplier roller 12 as the retainer roller 10 and the supplier roller 12 rotate in respective directions thereof and the developing solution interposes in a slight clearance between the supplier roller 12 and the retainer roller 10. It should be noted that the supplier roller 12 and the retainer roller 10 may mutually abut at a predetermined nip pressure. However, the supplier roller 12 and the retainer roller 10 may be arranged to have a predetermined extent of clearance therebetween, which may be, for example, approximately 0.1 mm, so that the portion of the developing solution can be interposed effectively. The clearance may be as large as approximately 0.5 mm, for example.

The supplier roller 12 is provided with a plurality of grooves formed at a predetermined interval on surface thereof. A depth of each groove is for example several tens micrometers, and a density of the grooves is for example in a range from one hundred to two hundred per inch. The grooves may be formed by using a known technique, for example a technique to form a gravure roll. The grooves may not be necessarily formed to be parallel to the rotation axis of the supplier roller 12, but may be for example formed to be oblique with respect to the rotation axis. The grooves are thus adapted to receive the developing solution when a substantial amount of the developing solution is applied to the supplier roller 12.

As the supplier roller 12 rotates further, the surface of the supplier roller 12 is scraped by the blade unit 121, so that an excessive amount of the developing solution is scraped off and only the developing solution in the grooves stays on the supplier roller 12.

The supplier roller 12 is disposed so as to oppose to the developing roller 14 and abut evenly in parallel with the rotation axis of the rotation axis thereof to the surface of the developing roller 14 at a predetermined nip pressure. With this configuration, the grooves of the supplier roller 12 with the developing solution therein reaches to a contact point with the developing roller 14, the developing solution in the grooves is transferred to the surface of the developing roller 14, and thus a thin layer of the developing solution is evenly formed on the surface of the developing roller 14. (Thickness of the layer depends on the depth of the grooves).

A surface of the developing roller 14 is charged by the corona charger 32 that extends in parallel with the rotation axis of the developing roller 14, and is applied a voltage of approximately +500 V. Further, the photoconductive drum 18 is applied a voltage and uniformly charged to a predetermined level, which is approximately +700 V, by the corona charger 34, which extends in parallel with the rotation axis of the photoconductive drum 18.

The photoconductive drum 18 is further rotated and exposed to the laser beam 30 that scans the surface of the photoconductive drum 18 in parallel with the rotation axis of the photoconductive drum 18 (i.e., a main scanning direction) according to the image data, and a latent image is formed on the surface of the photoconductive drum 18, as regions where the latent image is formed gains a lower potential, for example as low as −100 V, due to an effect of the laser beam 30.

The photoconductive drum 18 with the latent image on the surface is further rotated, and between the region excluding the latent image on the photoconductive drum 18, of which the electric potential is approximately +100 V, and the surface of a developing roller 14, of which the electric potential is approximately +500V, the toner remains closely stuck to the lower-potential region i.e. the surface of the developing roller 14, without being transferred to the region of which the electric potential is approximately +700 V and where no latent image exists. Consequently, the region excluding the latent image is not developed. By contrast, between the latent image region on the surface of the photoconductive drum 18 and the surface of the developing roller 14, the toner performs electrophoresis toward the lower-potential region. That is, the toner adheres to the latent image region on the surface of the photoconductive drum 18.

The squeeze roller 16 is disposed to be in contact with the photoconductive drum 18, and is adapted to remove the residual carrier solution from the surface of the photoconductive drum 18 by rotating in the counterclockwise direction. Therefore, on a portion of the photoconductive drum 18 that has passed the squeeze roller 16, merely toner without the carrier solution remains. This is how the latent image on the photoconductive drum 18 is developed, to turn into a toner image.

To the intermediate transfer roller 20 that rotates in the clockwise direction, a transfer bias of a reverse polarity to the toner is applied, which is approximately −100 V, so that the toner image developed on the surface of the photoconductive drum 18 is transferred as a primary step to the intermediate transfer roller 20, at the interface between the photoconductive drum 18 and the intermediate transfer roller 20.

The intermediate transfer roller 20 and the secondary transfer roller 22 are disposed so as to oppose to each other across a paper path of the recording sheet 26, and mutually abut at a predetermined nip pressure. The secondary transfer roller 22 rotates in the counterclockwise direction, and is applied a voltage of approximately −1 kV. The toner image transferred to the surface of the intermediate transfer roller 20 is transferred to the recording sheet 26 being carried along the paper path at the interface with the secondary transfer roller 22, by the effect of a transfer electric field, the nip pressure and so on, and thus the image is formed on the recording sheet 26. The recording sheet 26 is thereafter carried to the interface between the fixing rollers 36 and 38, wherein heat or pressure, or the like is applied to the recording sheet 26 to permanently fix the image thereon.

At a bottom portion 1*a* of the housing 1 is provided the stirrer roller 24 (see FIG. 2). The developing solution run down from the retainer roller 10, as well as the developing solution scraped off by the blade unit 121 and the blade 141, is collected in the bottom portion 1*a*. Further, the carrier solution removed from the photoconductive drum 18 is collected in the bottom portion 1*a*. The collected developing solution and the carrier solution are stirred and conveyed in a predetermined direction to the developing solution container by rotation of the stirrer roller 24. The developing solution collected as above in the developing solution container is thereafter provided with additional carrier solution so that toner density thereof is adjusted to a predetermined level.

Figure 3:
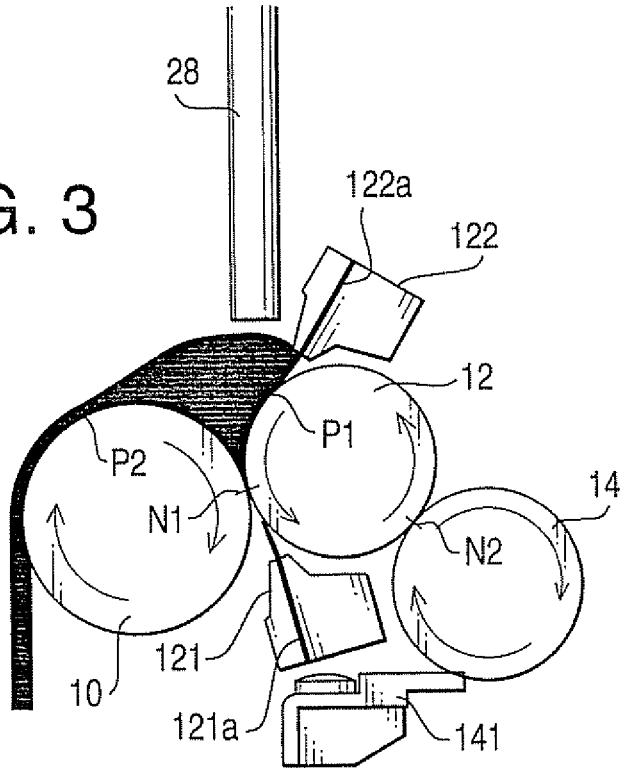
FIG. 3 is a cross-sectional side view showing the structure around the developing unit in the wet type printer according to an embodiment of the present invention.
Figure 4:
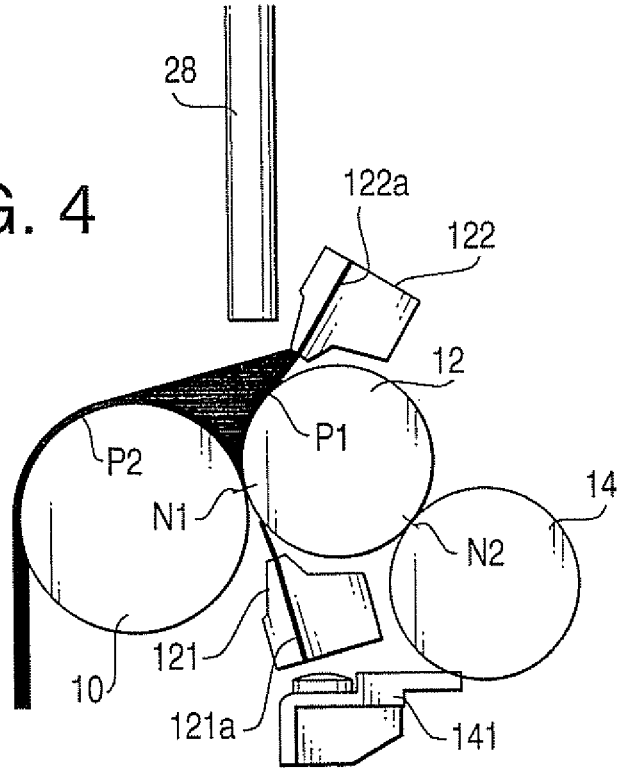
FIG. 4 is another cross-sectional side view showing the structure around the developing unit in the wet type printer according to an embodiment of the present invention.
Figure 5:
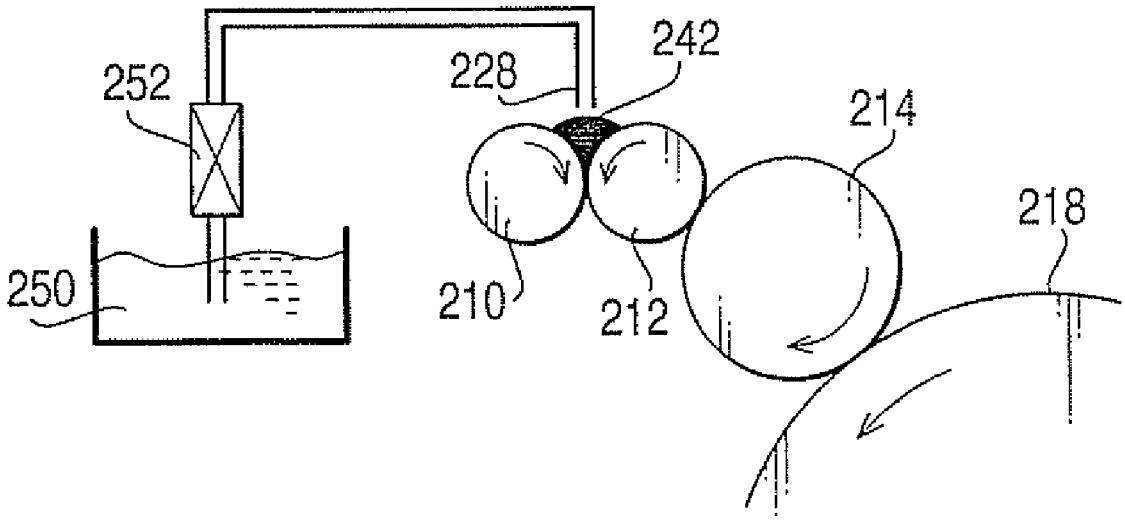
FIG. 5 PRIOR ART
FIG. 5 is an illustrative diagram showing a structure of a conventional wet type image forming apparatus.

FIGS. 3 and 4 are cross-sectional side views showing the structure around the developing unit 50 in the wet type printer 100 according to an embodiment of the present invention. In FIGS. 3 and 4, a topmost portion of the retainer roller 10 is adapted to be at a position lower than a topmost portion of the supplier roller 12, although the topmost portions of the retainer roller 10 and the supplier roller 12 may be at a same horizontal level, or the topmost portion of the retainer roller 10 may be at a position higher than that of the supplier roller 12.

The blade units 121, 122, which are identical to each other in form, respectively include a blade 121*a* and a blade 122*a*, and are configured to extend in parallel with the rotation axis of the supplier roller 12 (see FIG. 2). The blades 121*a*, 122*a* are arranged to be in contact with the surface of the supplier roller 12. The blade unit 121 is located downstream with respect to the rotating direction of the supplier roller 12, whilst the blade unit 122 is located upstream. The blades 121*a*, 122*b* can be made of resilient metal, resin, and the like, and thickness thereof is in a range from approximately 0.1 mm to 2 mm. It is preferable that, in the cross-sectional side views as shown in FIGS. 3 and 4, an angle between the blade 122*a* and a tangent line of the supplier roller 12 with the blade 122*a* is an acute angle at the upstream side with respect to the rotating direction of the supplier roller 12, so that the retained portion of the developing solution can be effectively prevented from flowing down on the developing roller 14, whilst a portion of the developing solution still remaining on the surface of the supplier roller 12 can be prevented from being accumulated at the angle between the blade 122*a* and the tangent line of the supplier roller 12. However, the angle between the blade 122*a* and the tangent line may be a right angle or an obtuse angle.

The blade unit 122 may be located at a position where an edge of the blade 122*a* comes in a position between a pit portion of the retainer roller 10 and the supplier roller 12 N1) and a pit portion of the supplier roller and the developing roller 14 (N2). That is, the blade 122*a* of the blade unit 122 is arranged to have the edge thereof located at a position which is on a left-hand side (see FIGS. 3 and 4) of a vertical line (not shown) passing through the rotation axis of the supplier roller 12.

The developing solution supplying tube 28 may be located at a position where a tip end thereof comes in between a position above P1, where the blade 122*a* is in contact with the supplier roller, and a position above P2, which is the topmost portion of the retainer roller 10.

FIG. 3 is a cross-sectional side view showing the structure around the developing unit 50 during a printing operation according to an embodiment of the present invention. The developing solution supplied via the developing solution supplying tube 28 is pooled in the pit portion 41. The pooled developing solution is conveyed to the interface of the retainer roller 10 and the supplier roller 12 by the rotation of the retainer roller 10 and the supplier roller 12. A portion (an excessive amount) of the pooled developing solution may overflow from the pit portion 41 and run down to the bottom portion 1*a* of the housing, however, it should be noted that the developing solution is not allowed to run down from the right-hand side of the blade 122*a*, as the blade 122*a* blocks the flow. With this configuration, no excessive amount of the developing solution may run down on the developing roller 14. Therefore, a substantial amount of developing solution can be supplied to the pit portion 41 from the developing solution container via the developing solution supplying tube 28. Technically, the amount of developing solution to be supplied from the developing solution container can be as much as an amount of the developing solution to be carried back to the developing solution container. It should be noted that, as the pump to carry the collected developing solution to the developing solution container is a gear-driven pump in the present embodiment, the developing solution of which amount is increased to an extent can be smoothly carried when electric current to drive the pump is substantially high.

FIG. 4 is a cross-sectional side view showing the structure around the developing unit 50 immediately after each of the rollers stopped rotating according to an embodiment of the present invention. As the retainer roller 10 and the supplier roller 12 stop rotating, a top surface of the developing solution pooled in the pit portion 41 is flattened, and the excessive amount of the developing solution starts to overflow. In this situation, however, the excessive developing solution is blocked by the blade 122*a*, and is not allowed to flow from the right-hand side of the supplier roller 12.

With the above-described configuration, the developing roller 14 can prevent the excessive developing solution from running down thereon. It should be noted that the blade unit 122 can be configured to be identical to the blade unit 121, which may have been conventionally used, therefore, no additional and/or dedicated manufacturing process is required. Further, as the developing solution supplying tube 28 can be located in a position between a position where the blade 122*a* is in contact with the supplier 12 and a position where the topmost portion of the retainer roller 10 is located, and furthermore, as the topmost portion of the retainer roller 10 may not be necessarily located at the same level as the topmost portion of the supplier roller 12, the configuration of the wet type printer 100 may be provided with more options in design thereof.

Although the present invention has been described based on the foregoing embodiment it is to be understood that the present invention is not limited thereto, but various modifications may be made without departing from the scope of the present invention.

The present disclosure relates to the subject matter contained in Japanese Patent Application No. 2005-142208, filed on May 16, 2005, which is expressly incorporated herein by reference in its entirety.

What is claimed is:

1. A wet type image forming apparatus, comprising;

a latent image forming unit including a photoconductive drum; and a developing unit including a developing solution supplying system that supplies developing solution to a developing roller, the developing roller being adapted to supply toner contained in the developing solution to the photoconductive drum, wherein the developing solution supplying system includes a first roller and a second roller, the first roller and the second roller being arranged in vicinity to each other, the second roller being in contact with the developing roller, wherein a portion of the developing solution is retained in a pit portion between the first roller and the second roller, wherein the developing solution supplying system is provided with a flow blocking system to prevent the developing solution from flowing down from an upstream surface of the second roller with respect to a rotating direction of the second roller toward the developing roller.

2. The wet type image forming apparatus according to claim 1, wherein the flow blocking system includes a resilient plate member, of which an edge is in contact with the surface of the second roller, and wherein the flow blocking system is located at a position where the edge of the plate member is disposed between a contact point of the first roller and the second roller and a contact point of the second roller and the developing roller on the upstream surface of the second roller with respect to the rotating direction of the second roller.

3. The wet type image forming apparatus according to claim 2, wherein the plate member is disposed to form an acute angle with a tangent plane of the surface of the second roller at a position where the edge of the plate member is in contact with the surface of the second roller in an upstream side with respect to the rotating direction of the second roller.

4. The wet type image forming apparatus according to claim 1 wherein the developing solution supplying system is provided with a layer forming system, which is adapted to scrape off an excessive amount of the developing solution being supplied to the surface of the second roller, and is disposed in a position between a contact point of the first roller and the second roller and a contact point of the second roller and the developing roller on a downstream surface of the second roller with respect to the rotating direction of the second roller, and wherein the flow blocking system is configured to be identical to the layer forming system.

5. The wet type image forming apparatus according to claim 1, wherein the developing unit is provided with a developing solution collecting system being adapted to collect an excessive amount of the developing solution residually produced in a process to supply the toner to the photoconductive drum, and wherein a maximum allowable amount of the developing solution to be supplied to the developing solution supplying system is equivalent to a maximum allowable amount of the developing solution to be collected by the developing solution collecting system.

6. The wet type image forming apparatus according to claim 1, wherein the first roller and the second roller are in contact with each other.

7. The wet type image forming apparatus according to claim 1, wherein a clearance is provided between the first roller and the second roller.

* * * * *